US009833887B1

(12) United States Patent
Liu

(10) Patent No.: US 9,833,887 B1
(45) Date of Patent: Dec. 5, 2017

(54) REPLACEABLE MAGNETIC SCREW-LOCKING DEPTH POSITOINING HEAD

(71) Applicant: Tsai-Fa Liu, Taichung (TW)

(72) Inventor: Tsai-Fa Liu, Taichung (TW)

( * ) Notice: Subject to any disclaimer, the term of this patent is extended or adjusted under 35 U.S.C. 154(b) by 0 days.

(21) Appl. No.: 15/271,227

(22) Filed: Sep. 21, 2016

(51) Int. Cl.
*B25B 21/00* (2006.01)
*B25B 23/12* (2006.01)
*B25B 23/00* (2006.01)
*B25B 23/10* (2006.01)

(52) U.S. Cl.
CPC ..... *B25B 23/12* (2013.01); *B25B 21/00* (2013.01); *B25B 23/0035* (2013.01); *B25B 23/10* (2013.01); *B25B 23/101* (2013.01)

(58) Field of Classification Search
CPC ..... B25B 23/12; B25B 23/101; B25B 23/10; B25B 23/0035; B25B 21/00; Y10T 279/3406; Y10T 408/8925; B23B 49/005; B23B 51/104
USPC ..... 81/451, 438, 429
See application file for complete search history.

(56) References Cited

U.S. PATENT DOCUMENTS 5,012,708 A * 5/1991 Martindell ..... B25B 23/12 81/429
5,724,873 A * 3/1998 Hillinger ..... B25B 23/12 81/125
5,996,452 A * 12/1999 Chiang ..... B25B 15/001 279/157
6,931,967 B1 * 8/2005 Chang ..... B25B 15/001 81/125
7,096,768 B1 * 8/2006 Chen ..... B25B 23/12 81/125
7,114,728 B2 * 10/2006 Chen ..... B23B 31/107 279/155
7,261,023 B2 * 8/2007 Taguchi ..... B25B 15/001 81/438
7,387,054 B2 * 6/2008 Rajotte ..... B25B 15/001 279/75
7,424,841 B2 * 9/2008 Liu ..... B25B 15/001 279/22
7,565,854 B2 * 7/2009 Chiang ..... B25B 15/001 279/75
2009/0174157 A1 * 7/2009 Chang ..... B25B 15/001 279/99

(Continued)

*Primary Examiner* — Larry E Waggle, Jr.
*Assistant Examiner* — Danny Hong
(74) *Attorney, Agent, or Firm* — Jackson IPG PLLC; Demian K. Jackson

(57) ABSTRACT

A replaceable magnetic screw-locking depth positioning head includes a main body formed by a rod, a positioning sleeve, a buckling ring, a cushioning member and a magnetic member. The positioning sleeve has a stepped slot, so that the buckling ring can be installed into the stepped slot more conveniently, and the stepped slot contains a cushioning member and a magnetic member. The cushioning member provides a buffering/shock absorbing effect and a better manufacture precision of the main body, and the magnetic member provides a better positioning effect for locking the screw, and a first slot is formed at a free end of the stepped slot for accommodating debris. The positioning head of the present invention has the advantages of high manufacturing efficiency, production efficiency and manufacturing precision.

2 Claims, 4 Drawing Sheets

(56) References Cited

U.S. PATENT DOCUMENTS

2013/0328276 A1* 12/2013 Moss ..... B25B 23/0035
279/102

* cited by examiner

REPLACEABLE MAGNETIC SCREW-LOCKING DEPTH POSITOINING HEAD

BACKGROUND OF THE INVENTION

1. Fields of the Invention

The present invention relates to a positioning head, more particularly to a replaceable magnetic screw-locking depth positioning head.

2. Description of the Related Art

With reference to FIGS. 6 and 7 for a conventional positioning head, the conventional positioning head comprises a main body formed by a rod 50 and a positioning sleeve 52, a tool member 501 extended from an end of the rod 50, and a latch slot 502 concavely formed between the tool member 501 and the rod 50 and latched to a buckling ring 62, wherein the positioning sleeve 52 is formed by combining an abutting member 521 and a sleeve member 522. An abutting surface 54 is disposed parallel to a surface of the abutting member 521, and a containing slot 56 is concavely formed on an inner surface of the abutting member 521, and a magnetic member 58 is installed in the containing slot 56, and a hole 581 is formed on the magnetic member 58, and a free end of the sleeve member 522 has an opening 523, and a ring abutting slot 60 is formed between the opening 523 and the containing slot 56, and the opening 523, the ring abutting slot 60 and the containing slot 56 are communicated with one another. In the aforementioned structure, when the tool member 501 is passed into the positioning sleeve 52 and the hole 581, the buckling ring 62 is latched to the ring abutting slot 60.

Although the magnetic member 58 provides a screw suction force, there is no extra room of the containing slot 56 to accommodate the chips produced the tool member 501 during the screwing process after the magnetic member 58, so that the chips fall all over the place. When the screw is locked to a certain extent, an end of the tool member 501 will not be able to move further due to the chips.

SUMMARY OF THE INVENTION

Therefore, it is a primary objective of the present invention to provide a positioning head, particularly a replaceable magnetic screw-locking depth positioning head, that provides the space for accommodating the chips and also provides a more convenient installation of the buckling ring, and reduces the vibration when the screw is latched to the tool member to achieve good manufacturing efficiency, production efficiency and manufacturing precision.

According to the invention, a replaceable magnetic screw-locking depth positioning head comprises a main body, formed by a rod, a positioning sleeve, a buckling ring, a cushioning member and a magnetic member.

According to the invention, the rod has a position limiting surface disposed at an end thereof, and a position increasing member is axially extended from the position limiting surface, and a ring groove is concavely formed at the other end of the position increasing member opposite to the position limiting surface, and a tool member is axially extended and protruded from the ring groove, and the ring groove has a radial cross-sectional diameter smaller than a radial cross-sectional diameter of a connecting end of the tool member and the ring groove, and the positioning sleeve having an abutting member from which a sleeve member is concavely extended;

According to the invention, the abutting member has a flat abutting surface, and an inner side has a first slot concavely formed thereon, and an inner side of the joint between the sleeve member and the abutting member has a second slot concavely formed thereon, and the second slot has a radial cross-sectional diameter smaller than the radial cross-sectional diameter of the first slot, and the second slot has a ring abutting edge concavely formed at the other end opposite to the first slot, and the ring abutting edge has a radial cross-sectional diameter smaller the radial cross-sectional diameter of the second slot, and the first slot, the second slot and the ring abutting edge jointly form a stepped slot;

According to the invention, the sleeve member has a sleeve bottom surface disposed at a free end thereof, and a penetrating hole passes through the center of the sleeve bottom surface, and the penetrating hole has a radial cross-sectional diameter smaller than the radial cross-sectional diameter of the ring abutting edge, and the penetrating hole and the stepped slot are communicated with each other; wherein the buckling ring is installed at the ring abutting edge;

According to the invention, the cushioning member and the magnetic member are disposed at the second slot, and the cushioning member has an end abutting the buckling ring and the other end abutting the magnetic member, and a first through hole passes through the center of the cushioning member, and a second through hole passes through the center of the magnetic member, thereby, the tool member is passed into to the penetrating hole, the first through hole and the second through hole, so that the ring groove is latched to the buckling ring.

The present invention has the following advantages:

1. The abutting surface of the positioning sleeve is arranged horizontally, so that when a screw is locked to the main body, and the abutting surface is contacted with a wall surface, the rod will be restricted to be locked by the screw further, so as to prevent locking the screw into a too-large depth and control the locking depth of each screw precisely in order to avoid unequal heights. When the tool member is worn out to a certain extent, users simply remove the rod, and sheath another rod to the positioning sleeve for a continual use, so as to reduce the manufacturing cost and improve competitiveness.

2. Since the stepped slot has a stepped structure with the first slot greater than the second slot and the second slot greater than the ring abutting edge, the stepped slot can be manufactured easily, and the buckling ring can be installed to the ring abutting edge conveniently to improve the production efficiency of the positioning sleeve. If it is necessary to replace the worn buckling ring, the users will simply need to remove and replace the cushioning member and the magnetic member.

3. In screwing, the position limiting surface abuts the sleeve bottom surface while pressing the abutting surface to touch the wall surface, so as to prevent the screw from being locked to a too-large depth. The position increasing member provides an error tolerance for installing the rod and the error tolerance acts as a buffering distance between the position limiting surface and the sleeve bottom surface when the main body is screwed and locked.

4. The cushioning member has the buffering/shock absorbing effect, so that a better manufacturing precision of the tool member is achieved.

5. The first slot provides an accommodating space, so that when the tool member is used, chips of the wall surface on which the tool member works are created, and the chips will be stored in the first slot.

6. The magnetic member provides a suction force, so that when the screw is latched to the tool member, the positioning head is more stable and will not fall out easily, so as to improve the work yield and efficiency.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
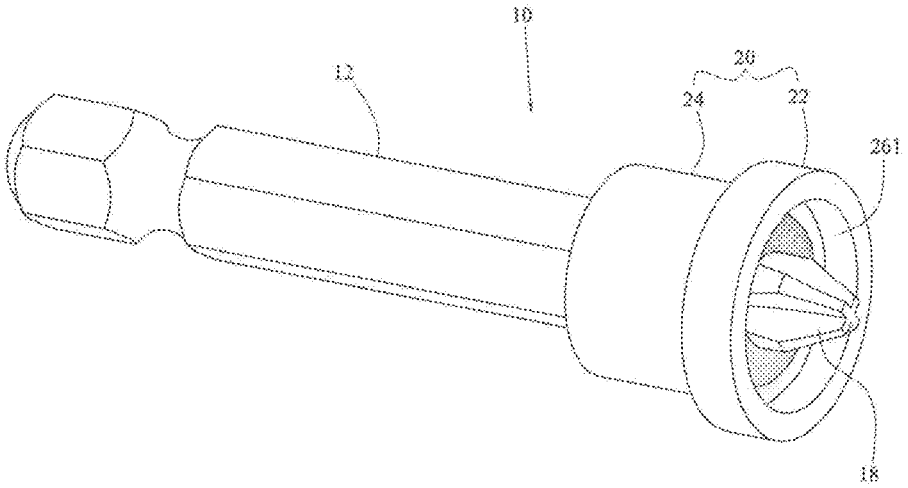
FIG. 1 is a perspective view of the present invention.
Figure 2:
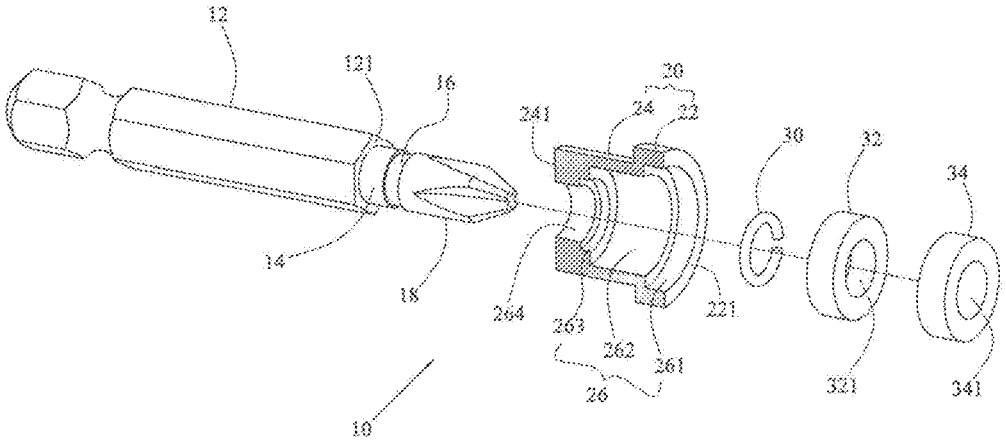
FIG. 2 is an exploded view of the present invention.
Figure 3:
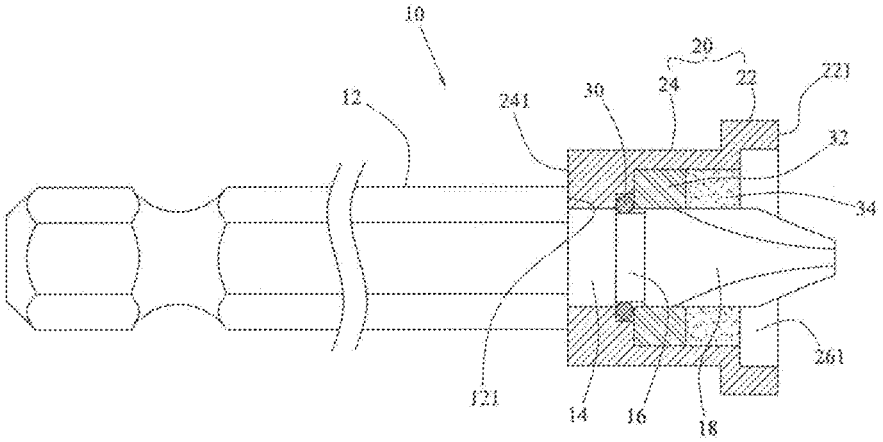
FIG. 3 is a cross-sectional view of a positioning slot combined with a rod of the present invention.

With reference to FIGS. 1 to 3 for a replaceable magnetic screw-locking depth positioning head of the present invention, the replaceable magnetic screw-locking depth positioning head comprises a main body 10 formed by a rod 12, a positioning sleeve 20, a buckling ring 30, a cushioning member 32, and a magnetic member 34.

An end of the rod 12 is disposed on a position limiting surface 121, and a position increasing member 14 is axially extended from the position limiting surface 121, and a ring groove 16 is concavely formed at the other end of the position increasing member 14 opposite to the position limiting surface 121, and a tool member 18 is axially extended and protruded from the ring groove 16, wherein the ring groove 16 has a radial cross-sectional diameter smaller than the radial cross-sectional diameter of the connecting end of the tool member 18 and the ring groove 16.

The positioning sleeve 20 has an abutting member 22 from which a sleeve member 24 is concavely extended.

The surface of the abutting member 22 is a flat abutting surface 221-2, and a first slot 261 is concavely formed on an inner surface of the abutting member 22, and a second slot 262 is formed on an inner surface of a joint of the sleeve member 24 and the abutting member 22. The second slot 262 has a radial cross-sectional diameter smaller than the radial cross-sectional diameter of the first slot 261, and a ring abutting edge 263 is concavely formed at the other end of the second slot 262 opposite to the first slot 261, and the ring abutting edge 263 has a radial cross-sectional diameter smaller than the radial cross-sectional diameter of the second slot 262. The first slot 261, the second slot 262 and the ring abutting edge 263 jointly form a stepped slot 26.

A sleeve bottom surface 241 is disposed at a free end of the sleeve member 24. A penetrating hole 264 is formed and passed through the center of the sleeve bottom surface 241, and the penetrating hole 264 has a radial cross-sectional diameter smaller than the radial cross-sectional diameter of the ring abutting edge 263, and the penetrating hole 264 and the stepped slot 26 are penetrated and communicated with each other.

The buckling ring 30 is installed to the ring abutting edge 263.

The cushioning member 32 and the magnetic member 34 are installed to the second slot 262, and the cushioning member 32 has an end abutting the buckling ring 30 and the other end abutting the magnetic member 34, and a first through hole 321 is passed through the center of the cushioning member 32, and a second through hole 341 is passed through the center of the magnetic member 34.

With the aforementioned structure, the tool member 18 is passed into the penetrating hole 264, the first through hole 321 and the second through hole 341, so that the ring groove 16 is latched to the buckling ring 30.

Wherein, the position increasing member 14 is an equidistant, equal-height circular member, and the position increasing member 14 has a radial cross-sectional diameter smaller than the radial cross-sectional diameter of the position limiting surface 121 and the penetrating hole 264.

Figure 4:
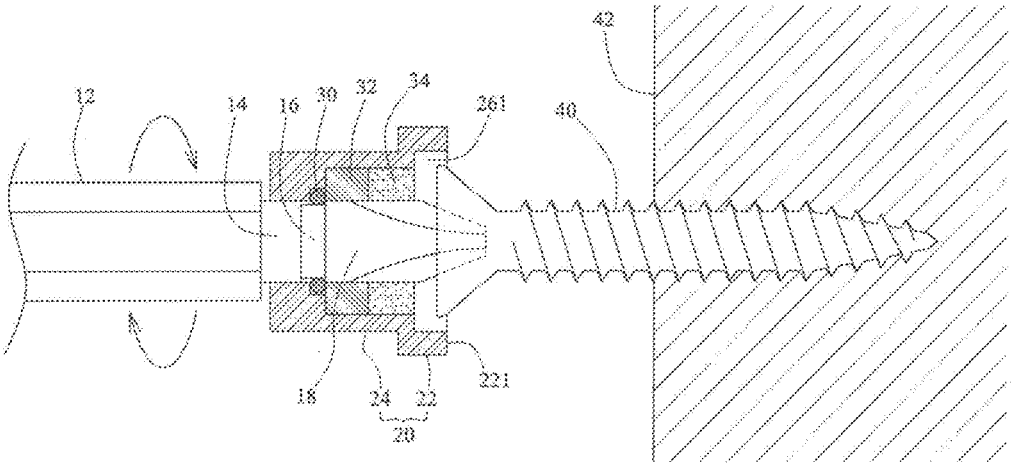
FIG. 4 is a first schematic view of a using status of a main body combined with a screw in accordance with the present invention.
Figure 5:
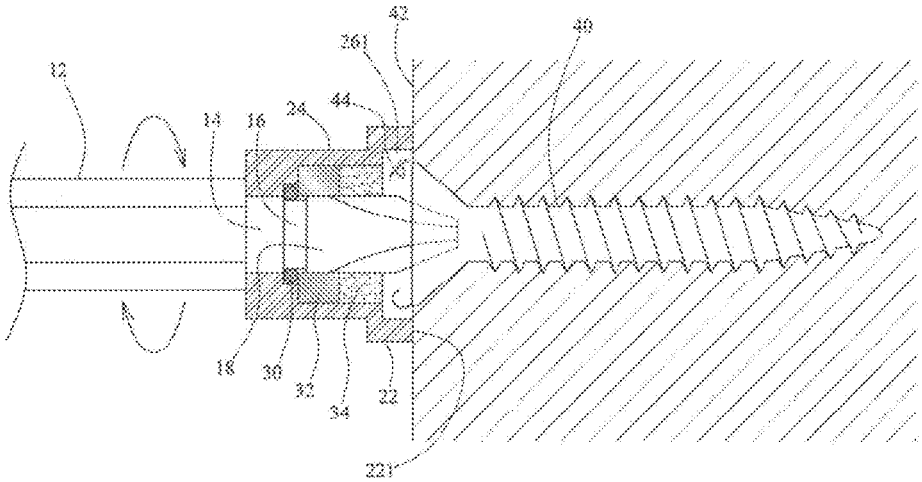
FIG. 5 is a second schematic view of a using status of a main body combined with a screw in accordance with the present invention.
Figure 6:
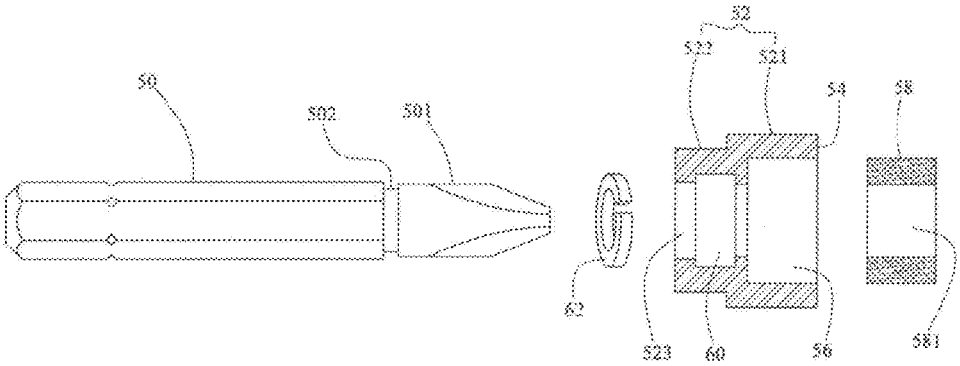
FIG.6 PRIOR ART
FIG. 6 is an exploded view of a prior art.
Figure 7:
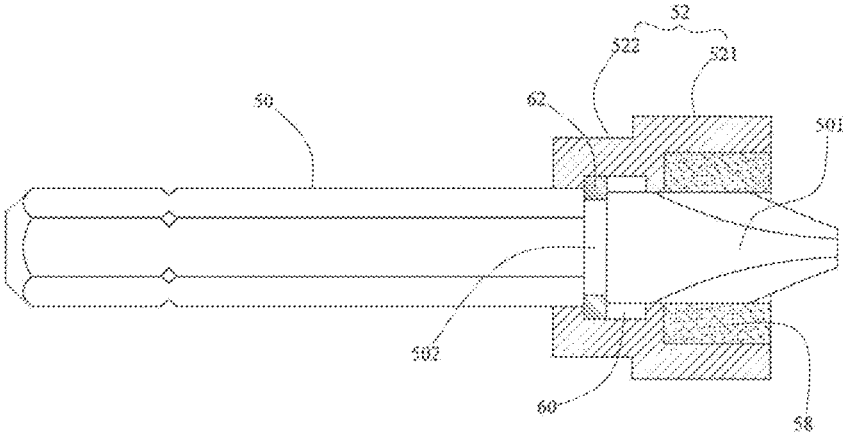
FIG.7 PRIOR ART
FIG. 7 is a cross-sectional view of the prior art.

With reference to FIGS. 4 and 5 together with FIG. 2, a screw 40 is installed to the tool member 18, such that when the rod 12 is rotated, the tool member 18 is driven to rotate at the internal diameter of the cushioning member 32 and the magnetic member 34 while driving the screw 40 into a wall surface 42. Now, a plurality of chips falls into the first slot 261 during the screwing process. When the abutting surface 221 abuts at the wall surface 42, and the position limiting surface 121 abuts the sleeve bottom surface 241, the tool member 18 will be unable to move in the direction towards the wall surface 42 anymore, so that the depth of the screw 40 entering into the wall surface 42 meets the user's expected depth.

Since the magnetic member 34 has a strong magnetic field, therefore a stable positioning effect of the screw 40 can be achieved even the screw 40 is not in contact.

When the rod 12 is rotated, the cushioning member 32 can provide the effect of absorbing the vibration caused by the rotation of the tool member 18 to improve the manufacture precision.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A replaceable magnetic screw-locking depth positioning head, comprising: a main body, formed by a rod, a positioning sleeve, a buckling ring, a cushioning member and a magnetic member; wherein the rod has a position limiting surface disposed at an end thereof, and a position increasing member is axially extended from the position limiting surface, and a ring groove is concavely formed at an end of the position increasing member opposite to the position limiting surface, and a tool member is axially extended and protruded from the ring groove, and the ring groove has a radial cross-sectional diameter smaller than a radial cross-sectional diameter of a connecting end of the tool member and the ring groove, and the positioning sleeve having an abutting member from which a sleeve member is concavely extended; wherein the abutting member has a flat abutting surface, and an inner side has a first slot concavely formed thereon, and an inner side of a joint between the sleeve member and the abutting member has a second slot concavely formed thereon, and the second slot has a radial cross-sectional diameter smaller than a radial cross-sectional diameter of the first slot, and the second slot has a ring abutting edge concavely formed at an end opposite to the first slot, and the ring abutting edge has a radial cross-sectional diameter smaller the radial cross-sectional diameter of the second slot, and the first slot, the second slot and the ring abutting edge jointly form a stepped slot; wherein the sleeve member has a sleeve bottom surface disposed at a free end thereof, and a penetrating hole passes through a center of the sleeve bottom surface, and the penetrating hole has a radial cross-sectional diameter smaller than the radial cross-sectional diameter of the ring abutting edge, and the penetrating hole and the stepped slot are communicated with each other; wherein the buckling ring is installed at the ring abutting edge; wherein the cushioning member and the magnetic member are disposed at the second slot, and the cushioning member has an end abutting the buckling ring an opposite end abutting the magnetic member, and a first through hole passes through a center of the cushioning member, and a second through hole passes through a center of the magnetic member; wherein the tool member is configured to pass into the penetrating hole, the first through hole and the second through hole, so that the ring groove is latched to the buckling ring.

2. The replaceable magnetic screw-locking depth positioning head of claim 1, wherein the position increasing member is an equidistant equal-height circular member, and the position increasing member has a radial cross-section diameter smaller than a radial cross-sectional diameter of the position limiting surface and the radial cross-sectional diameter of the penetrating hole.

* * * * *